United States Patent [19]

Mikos

[11] 4,022,039

[45] * May 10, 1977

[54] KEY EJECTOR LOCK

[75] Inventor: Aloysius J. Mikos, Skokie, Ill.

[73] Assignee: Chicago Lock Co., Chicago, Ill.

[ * ] Notice: The portion of the term of this patent subsequent to July 27, 1993, has been disclaimed.

[22] Filed: Mar. 8, 1976

[21] Appl. No.: 664,904

[52] U.S. Cl. ..... 70/388; 70/363
[51] Int. Cl.[2] ..... E05B 17/00; E05B 27/08
[58] Field of Search ..... 70/388, 414, 346–347, 70/349, 356, 360, 363

[56] References Cited

UNITED STATES PATENTS

| | | | |
|---|---|---|---|
| 240,397 | 4/1881 | Ehmer | 70/156 |
| 3,524,335 | 8/1970 | George | 70/363 |
| 3,661,001 | 5/1972 | Glass | 70/388 |

FOREIGN PATENTS OR APPLICATIONS

| | | | |
|---|---|---|---|
| 7,191 | 3/1907 | United Kingdom | 70/388 |

*Primary Examiner*—Robert L. Wolfe
*Attorney, Agent, or Firm*—Norman H. Gerlach

[57] ABSTRACT

A key ejector lock adapted for use in the door of a cabinet or other enclosure and which will eject the lock key in any rotational position thereof.

11 Claims, 11 Drawing Figures

KEY EJECTOR LOCK

BACKGROUND OF THE INVENTION

This invention relates to a key ejector lock for the door of a cabinet or other enclosure, particularly, for a refrigerator or freezer door.

Locks are employed on refrigerator and freezer cabinets for the purpose of preventing minors from obtaining access to the cabinets and, especially, to prevent minors from entering and becoming locked in the cabinets. The locks are low security locks, in that they do not embody key-operable tumblers. Instead, they have simpler key-operable mechanism for alternately securing and releasing for rotation a rotatable plug part movable between locked and unlocked positions. A characteristic of the locks is that they are designed to automatically eject the key when it is released, so that the key does not remain in the lock, where it is accessible to a minor. Preferably, the key is ejected in any rotational position thereof, so that under no circumstances will it remain in the lock. Such a lock is disclosed in U.S. Pat. No. 3,661,001.

In my copending patent application Ser. No. 599,154, now U.S. Pat. No 3,971,242, granted July 27, 1976, filed July 25, 1975 for "Key Ejector Lock", I have disclosed a key ejector lock constructed of fewer parts, thereby facilitating and reducing the cost of producing the parts and assembling them in a lock. The lock is more readily assembled by virtue of the construction of its parts, and in particular, it is assembled from the rear end of the lock. A rear end plug of the lock is inserted in the barrel into snap-fitting interengagement therewith, to secure the several parts in the lock. The rear end plug also is mounted in the lock barrel so as to minimize axial play and side play, to afford a tight, secure closure and minimize the required latching tolerances.

SUMMARY OF THE INVENTION

The key ejector lock of the present invention comprises a tubular barrel having an internal shouldered portion defining rearwardly opening circumferentially spaced notches, a tubular front end plug rotatably mounted in the barrel and having a front end wall, a cylindrical tubular side wall, and a keyway extending through the front end wall for operation of the plug by a key, the side wall having two diametrically opposed engagement slots extending longitudinally therethrough from the rear end thereof, a rear end plug rotatably mounted in the barrel and adapted for operative connection to a locking member, the rear end plug having a non-circular central slideway and two outer slideways open to the central slideway and extending outwardly from opposite sides thereof, the slideways extending longitudinally in the rear end plug from the front end thereof, a rotatable driver interposed between the plugs and mounted for axial reciprocal movement in the barrel, the driver having a head and a non-circular elongated body extending rearwardly from the head, the driver also having two lugs extending outwardly from opposite sides of the head and integral therewith, and two wings extending outwardly from opposite sides of the body longitudinally therealong and integral therewith and with the lugs, the lugs and the wings being received in respective engagement slots to provide a sliding drive connection between the front end plug and the driver, the driver body and the wings being received in the central and outer slideways, respectively, to provide a sliding drive connection between the driver and the rear end plug, the lugs being removably received in respective ones of the notches for securing the rear end plug in respective locked and unlocked rotational positions, a first spring interposed between the rear end plug and the driver and resiliently urging the driver and thereby the lugs forwardly in the barrel towards the shouldered portion, a key ejector received in the front end plug for axial reciprocal movement therein between the front end plug and the driver and engaged by a key inserted through the keyway, and a second spring interposed between the driver and the key ejector and resiliently urging the key ejector forwardly in the barrel, whereby insertion of a key in the keyway serves to move the key ejector rearwardly into abutting engagement with the driver, to thereby move the lugs rearwardly of the notches and free the rotatable parts for rotation and enable the key to rotate the front end plug for rotating the rear end plug between the locked and unlocked positions thereof, and the key ejector acts to eject the key when released in any rotational position thereof.

In a preferred embodiment of the invention, the driver head includes a base and a wall extending forwardly from the base and defining an opening for receiving the rear end of the second spring therein, whereby the lugs are continuous with the driver head across the width of the driver for a major proportion of the depth of the lugs.

The structure of the present invention essentially provides the advantages of the structure claimed in my above-identified copending application, and also is more rugged and durable, particularly, when exposed to abuse or rough handling. Thus, and especially in the case of locks incorporating plastic parts, creep or cold flow may take place owing to torque imposed on the parts when the lock is moved between locked and unlocked positions against resistance to movement of a locking cam, latch or the like operatively connected to the lock. At times, considerable torque may be encountered when a door handle is pulled strongly while the lock is closed. As another example, torque may be imposed on the parts when a key or other instrument is inserted insufficiently or improperly and therefore does not free the lock parts for rotation. The consequences of the foregoing stresses include wearing and distortion of the parts, which can result in malfunctioning and possibly forcing the lock. The present invention provides improvements in the driver structure, particularly, and in the cooperation of other elements therewith, resulting in increased dimensional stability under applied torque.

BRIEF DESCRIPTION OF THE DRAWINGS

The attached drawings illustrate preferred embodiments of the invention, without limitation thereto. In the drawings, like elements are identified by like reference symbols in each of the views, and.

DESCRIPTION OF THE PREFERRED EMBODIMENT

Figure 1:
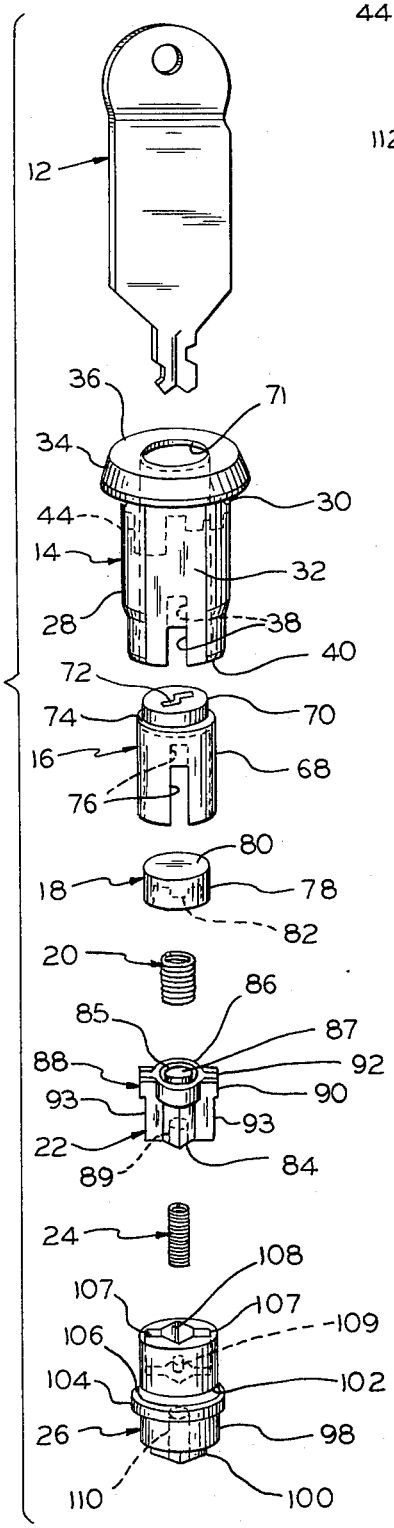
FIG. 1 is an exploded perspective view of a key ejector lock and a key therefor; according to the invention.
Figure 2:
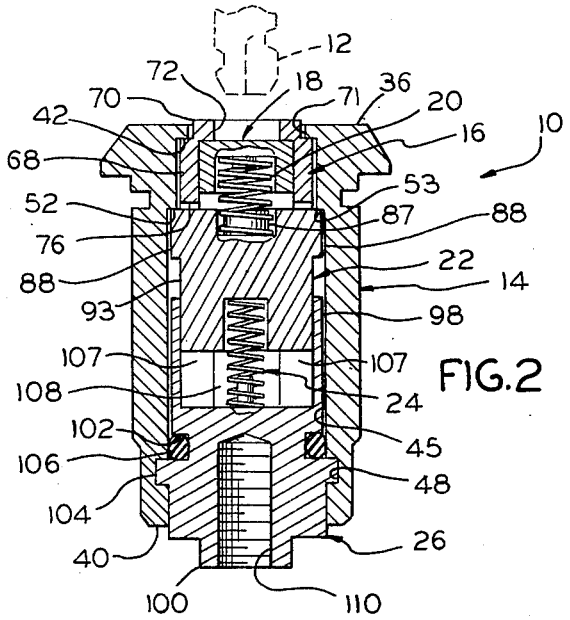
FIG. 2 is an enlarged axial sectional view of the lock in an initial condition.
Figure 3:
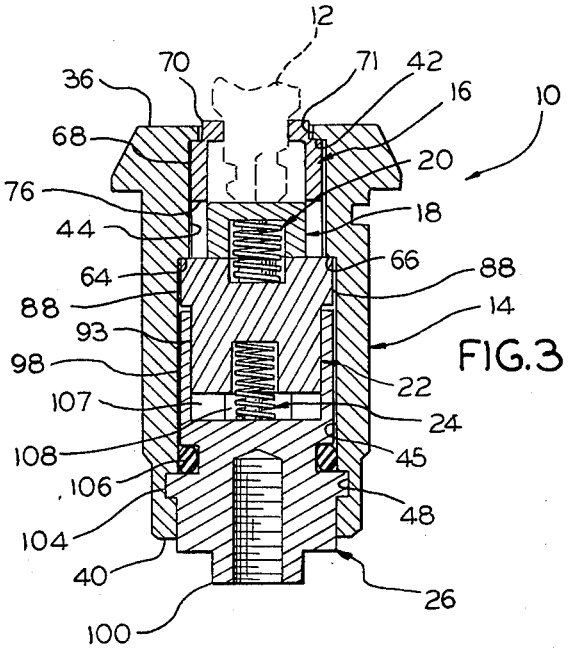
FIG. 3 is a view similar to FIG. 2 but with the lock in a transitional condition.
Figure 5:
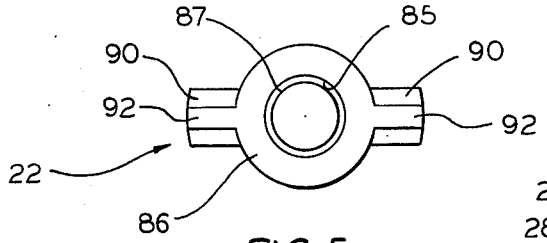
FIGS. 5 through 8 are further enlarged top plan, side elevational, bottom plan and end elevational views, respectively, of a driver element of the lock, the view of FIG. 6 being partly broken away and in section.

Referring to FIGS. 1-3 of the drawings, a lock and key assembly according to the invention includes a lock 10 of cylindrical construction and a flat-type key 12. The lock 10 includes a generally cylindrical tubular barrel 14, a generally cylindrical tubular front end plug 16, a cylindrical cup-like key ejector 18, a relatively light coil compression spring 20, an elongated driver or drive means 22, a relatively heavy coil compression spring 24, and a generally cylindrical rear end plug 26. The lock 10 thus has five principal parts, exclusive of the springs.

The barrel 14 includes a generally cylindrical tubular body 28 having on its outer surface, for mounting purposes, a pair of diametrically opposed transverse grooves 30, a pair of diametrically opposed flats 32 between the grooves, and a circular flange 34 around the front end 36 of the body 28. Two diametrically opposed longitudinal slits or slots 38 are provided in respective flats 32, in the rear end 40 of the barrel. The slits 38 provide for resilient expansion of the body 28 at the rear end 40, for a purpose subsequently described.

The inner surface of the body 28 of the barrel 14 is recessed adjacent the front end 36 of the barrel, to provide an annular internal retaining shoulder 42. The inner surface of the body 28 is further recessed in axially spaced relation to the shoulder 42, to form a circumferential shouldered portion 44 (FIGS. 1 and 4), which projects inwardly from the remaining portion 45 (FIGS. 2 and 3) of the body 28, disposed rearwardly thereof. An internal circumferential retaining groove 48 is provided in the slit portion of the barrel 14, adjacent to the inner ends of the slits 38. The groove 48 is substantially rectangular in cross section.

Figure 4:
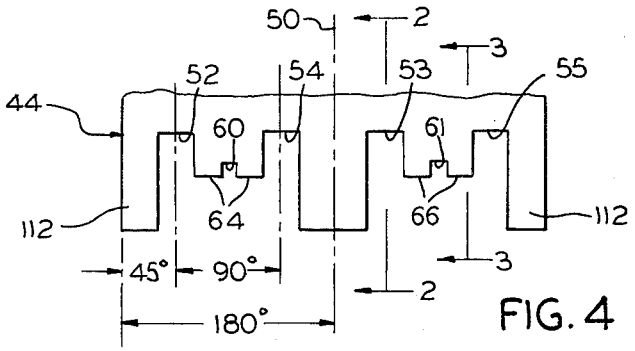
FIG. 4 is a fragmentary developed internal view of a shouldered portion of the body of the lock barrel.

The axis 50 of the shouldered portion 44, identified in FIG. 4, corresponds to the centerline of FIG. 2. The right half of FIG. 2 illustrates the shouldered portion 44 as seen when viewed as a section taken on line 2—2 of FIG. 4, and similarly, the right half of FIG. 3 illustrates the shouldered portion 44 when viewed as a section taken on line 3—3 of FIG. 4.

The shouldered portion 44 defines or is provided with a series of rearwardly opening, longitudinally extending notches, in circumferentially spaced relation around the barrel 14. Four principal notches 52–55 are provided, and they constitute two pairs of locking and unlocking notches, respectively. For convenience, the notches 52, 53 of one pair will be identified as the locking notches, and the notches 54, 55 of the remaining pair will be identified as the unlocking notches, although their functions may be interchanged. The principal notches 52–55 are angularly spaced apart around the barrel on 90-degree centers, and the notches in each pair 52, 53 and 54, 55 are angularly spaced apart on 180-degree centers.

The areas of the shouldered portion 44 between the non-paired adjacent principal notches 52, 54 and 53, 55 are notched to provide two diametrically opposed intervening notches 60 and 61 bordered by shoulders 64 and 66. The intervening notches 60 and 61 are angularly spaced from the adjacent principal notches 52–55 and from each other on 45° centers.

The front end plug 16 is rotatably mounted in the barrel 14. The front end plug 16 includes a cylindrical tubular side wall 68 received within the shouldered portion 44 of the barrel body 28, and a circular front end wall 70 received in a circular opening 71 in the barrel body 28 at its front end 36. The plug side wall 68 has an outside diameter which is approximately the same as, being slightly smaller than, the inside diameter of the shouldered portion 44. A non-linear or irregular keyway 72 extends through the front end wall 70 of the plug 16 in communication with the interior of the side wall 68 thereof. The front end wall 70 has a reduced diameter with respect to the side wall 68, thereby forming a shoulder 74 which engages the retaining shoulder 42 on the barrel body 28, for retention of the front end plug 16 within the barrel at the front end 36 thereof. A pair of diametrically opposed engagement slots 76 extend longitudinally through the plug side wall 68 from the rear end thereof.

The key ejector 18 is received in the front end plug 16. The key ejector 18 includes a cylindrical tubular side wall 78 and a circular front end wall 80. A cylindrical pilot stem 82 projects from the inner surface of the end wall 80, centrally of and spaced from the side wall 78. The front end wall 80 of the key ejector 18 seats on the inside of the front end wall 70 of the front end plug 16. The stem 82 receives the front end of the light spring 20 therearound.

The driver 22 is received in the barrel 14 and engages the front end plug 16. Referring particularly to FIGS. 1 and 5-8, the driver 22 includes a non-circular elongated body 84 surmounted by an intergral circular head 86 at the front end of the driver. The body 84 in the preferred embodiment is quadrilateral, being generally square. The head 86 is cup-shaped, and includes a cylindrical base or web portion 86A and an annular wall 86B defining a spring-receiving circular opening 85 in the front end of the head. The opening 85 extends into the head 86 for about one-half of its thickness, leaving a base 86A of about the same thickness. A cylindrical pilot stem 87 is integral with the base 86A, centered in the opening 85, and spaced from the wall 86B, for receiving the rear end of the light spring 20 therearound. A spring bore 89 extends longtiudinally in the body 84 from the rear end thereof, for receiving the front end of the heavy spring 24 in the bore.

Figure 6:
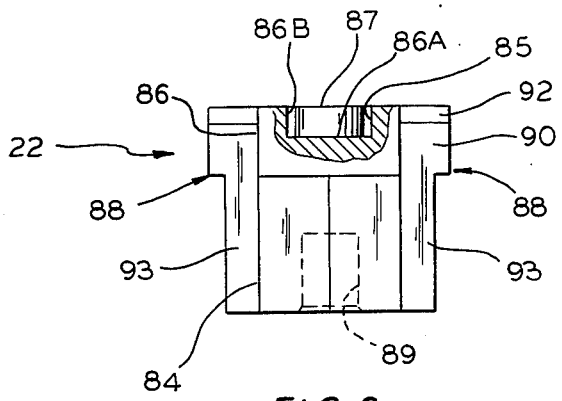
Figure 7:
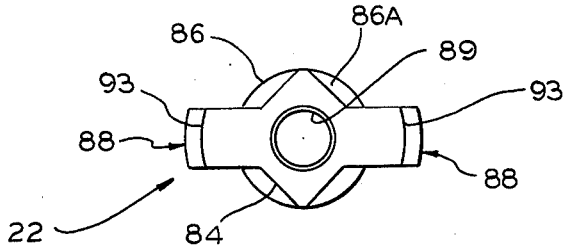

Two lug means 88 are integral with the wall 86B of the driver head 86 and extend radially outwardly therefrom in diametrically opposed relation. Each lug means 88 includes a lug or lug proper 90 and a detent 92 on the front surface of the lug. The lug 90 and the detent 92 have generally rectangular configurations with curved outer edges. As seen in FIGS. 2, 3 and 6, the lugs 90 are continuous with the head 86 across the width of the driver for a major proportion, about two-thirds, of the depth of the lugs, whereby the lugs are rigidly supported. The diameter or width of the driver 22 at the lug means 88 is approximately the same as, being slightly smaller than, the inside diameter of the rear portion 45 of the barrel 14.

Two generally rectangular anti-torque wings 93 having curved outer edges are integral with the driver body 84 at opposite corners thereof, and also are integral with the lugs 90. The wings 93 extend diagonally outwardly from body 84 longitudinally therealong, in the same planes with the lugs 90, but extending outwardly for shorter distances, for reasons which will appear. The diameter or width of the driver 22 at the wings 93 is at least about equal to the outside diameter of the side wall 68 of the front end plug 16, such driver diameter in the illustrative embodiment being the same as or slightly larger than the latter diameter.

The lug means 88 are received in the principal notches 52–55 in the shouldered portion 44 of the barrel 14, and the detents 92 conform to the outlines of and are received in the intervening notches 60 and 61. The thickness of the lug means 88, particularly the lugs 90, and the like thickness of the wings 93 is slightly less than the width of the engagement slots 76 of the front end plug 16, for receiving the lugs and wings slidably in the engagement slots.

The rear end plug 26 includes a cylindrical body 98 having a square stem 100 projecting integrally from its rear end. The diameter of the body 98 of the rear end plug is approximately the same as, being slightly smaller than, the inside diameter of the rear portion 45 of the barrel 14, and is larger than the diameter of the driver 22 at the wings 93. A circumferential groove 102 of rectangular cross section is provided in the outer surface of the plug body 98 at about the longitudinal center thereof. A circumferential mounting ring 104 of rectangular cross section is provided on the body 98 adjacent the groove 102 and integral with the body. An "0"-ring 106 is mounted in the groove 102 for sealing purposes. The mounting ring 104 is complementary to the retaining groove 48 in the barrel 14, the ring having but slightly smaller dimensions than the retaining groove.

A non-circular central slideway 108 is formed in the rear end plug body 98, extending inwardly from the front end thereof to a plane spaced forwardly of the circumferential groove 102. The central slideway 108 in the preferred embodiment, like the driver body 84, is quadrilateral, being generally square. The cross sectional dimensions of the central slideway 108 are slightly greater than those of the driver body 84, for slidably receiving the driver body therein. Two radially outer slideways 107 of generally rectangular cross section are formed in the plug body 98, and they are open to or in communication with the central slideway 108 and extend diagonally from opposite corners thereof to closely adjacent the periphery of the plug body 98. The outer slideways 107 have cross sectional dimensions which are slightly greater than those of the driver wings 93, for slidably receiving the wings therein. The outer slideways 107 are bordered by a continuous periphery on the plug body 98, and receive the wings 93 in enclosed relationship and projecting radially to points closely adjacent the periphery. A pilot stem 109 is centered on the bottom of the central slideway 108. The pilot stem 109 receives the rear end of the heavy spring 24 therearound. A tapped hole 110 extends axially through the square stem 100 and into the body 98.

When the lock 10 is assembled with the key 12 removed, as illustrated in FIG. 2 for one condition of the lock, the front end plug 16 is received in the barrel 14 with the plug shoulder 74 abutting the barrel retaining shoulder 42. The rear end plug 26 is received in the barrel 14 with the mounting ring 104 received in the retaining groove 48 and the "0"-ring 106 sealingly engaging the rear body portion 45 forwardly beyond the slits 38 (shown in FIG. 1). The front end plug 16 is seated on the rear end plug 26, and both plugs are rotatable in the barrel.

The driver 22 is interposed between the front and rear end plugs 16 and 26 and is mounted for axial reciprocal movement in the barrel 14. The body 84 of the driver 22 is received in the central slideway 108 of the rear end plug 26, and the wings 93 of the driver are received in the outer slideways 107 of the plug, thereby providing a sliding drive connection between the driver and the rear end plug. This drive connection has high dimensional stability against applied torque. The lug means 88 and the wings 93 of the driver 22 are received in the engagement slots 76 in the front end plug 16, thereby providing a sliding drive connection between the front end plug and the driver. This drive connection likewise has high dimensional stability. The heavy coil compression spring 24 is interposed between the rear end plug 26 and the driver 22 and resiliently urges the driver and thereby the lugs 90 forwardly in the barrel towards the shouldered portion 44.

The key ejector 18 is received in the front end plug 16 for axial reciprocal movement therein and in the barrel 14, between the front end plug and the driver 22. The light coil compression spring 20 is interposed between the driver 22 and the key ejector 18 and resiliently urges the key ejector forwardly in the front end plug 16 and in the barrel 14, so that the key ejector is spaced forwardly from the driver 22. The key ejector is abuttingly engaged by a key 12 inserted through the keyway 72.

The lug means 88 are removably received in the locking notches 52, 53 and the unlocking notches 54, 55, for securing the rear end plug 26 in respective locked and unlocked rotational positions. Thus, in the locked position of the rear end plug 26, one lug means 88 is received in one locking notch 52, and the remaining lug means 88 is received in the opposite locking notch 53, as illustrated in FIG. 2. When the driver 22 is rotated 90° in the clockwise direction (as viewed from the front end 36), the lug means 88 are received in the unlocking notches 54 and 55 in like manner. The illustrative arrangement thus provides for 90-degree rotation of the rear end plug 26 between locked and unlocked positions. A locking hook cam, latch or the like, not illustrated, which is secured on the square stem 100 of the rear end plug 26 by means of a screw inserted in the tapped hole 110, likewise is rotated 90° between a locked or latched position and an unlocked position.

In order to rotate the driver 22, it is necessary to move it rearwardly for a distance sufficient for the lug detents 92 to clear the shoulders 64 and 66 of the shouldered portion 44 of the barrel 14, after which the driver may be rotated 90° in opposite directions by operation of the key 12, as subsequently explained. Rotation of the driver 22 to a position wherein the lug detents 92 are beneath the notch shoulders 64 and 66 is illustrated in FIG. 3. In this view, the barrel 14 is rotated about 70° counterclockwise with respect to its position in FIG. 2, or, put another way, the rotatable parts of the barrel have been rotated about 70° in the clockwise direction with respect to the barrel.

Rotation of the driver 22 beyond 90° is prevented by the unnotched areas 112 of the shouldered portion 44, which project rearwardly beyond the notch shoulders 64 and 66. The intervening notches 60 and 61 are adapted for receiving the lug detents 92 when the driver 22 is rotated 45°. The intervening notches 60 and 61 are spaced so as to hold the rear end plug 26 in a transitional position between the locked and unlocked positions, in which transitional position a locking cam mounted on the rear end plug is removed from locking engagement with a keeper or the like on a cabinet but is not fully retracted into its utlimate unlocked position.

Insertion of the key 12 in the keyway 72 serves to move the key ejector 18 rearwardly into abutting engagement with the driver 22, to move the driver and thereby move the lug means 88 rearwardly of the principal notches 52–55, and also rearwardly of the intervening notches 60, 61, beyond the notch shoulders 64 and 66. The rotatable parts, including the front end plug 16, the driver 22, and the rear end plug 26, are freed for rotation, enabling the key to rotate the front end plug 16 for rotating the driver 22 and thereby the rear end plug 26 between the locked and unlocked positions of the latter.

When pressure on the key 12 is relaxed, the heavy spring 24 urges the driver 22 forwardly, so that the lug means 88 engage the barrel 14 in one of the diametrically opposed pairs of principal notches 52–55 and intervening notches 60, 61, depending upon the rotational position of the driver 22, to secure the rear end plug 26 against rotation. Ordinarily, the driver 22 will be rotated 90° between the locked and unlocked positions, with the lug means 88 engaged in the locking notches 52, 53 or the unlocking notches 54, 55 upon release of the key. The intervening notches 60, 61 are provided as a safety measure, so that in the event that the key 12 is released between the locked and unlocked positions of the rear end plug 26, the lug means 88 will be engaged, or upon movement of an attached locking cam will become engaged, in the intervening notches, to prevent unintended restoration of the rear end plug 26 to its locked position.

The light spring 20 bears on the key ejector 18 to exert constant pressure on the key 12 in the direction of the front end 36, so that any time the key is released completely, and in any rotational position thereof, the key will be propelled out of the keyway 72 and not allowed to remain in the lock. It is expected that the key then will be put away, inaccessible to minors.

In the embodiment of FIGS. 1–8, the barrel 14, the front end plug 16, the key ejector 18, the driver 22, and the rear end plug 26 advantageously are constructed of plastic, each part being molded or otherwise formed integrally in one piece, although the parts may be constructed of other materials. Preferably, the parts are constructed of synthetic thermoplastic material, such as nylon or acetal resin. The "O"-ring 106 is constructed of suitable elastomeric material.

The lock 10 is assembled by loading the barrel 14 from its rear end 40, inserting, in order, the front end plug 16, the ejector 18, the light spring 20, the driver 22, the heavy spring 24, and the rear end plug 26. The rear end 40 of the barrel 14 is resiliently expanded or spread, to permit entry of the mounting ring 104 of the rear end plug 26 into the barrel. When the mounting ring 104 reaches the retaining groove 48 in the barrel, the ring snaps into the groove as the end of the barrel returns to its original configuration. In this manner, the parts are secured in the lock with but simple operations.

The manner of mounting the rear end plug 26 results in very little axial and side play. Thus, the mounting ring 104 fits relatively snugly in the retaining groove 48, to minimize both axial and side play. An especially tight fit may be achieved with plastic parts and by virtue of the slits 38 in the barrel 14. Provision of the "O"-ring 106 additionally reduces side play while establishing a vapor barrier between the rear end 40 of the barrel, inside the cabinet, and the front end 36 of the barrel, outside of the cabinet.

Figure 9:
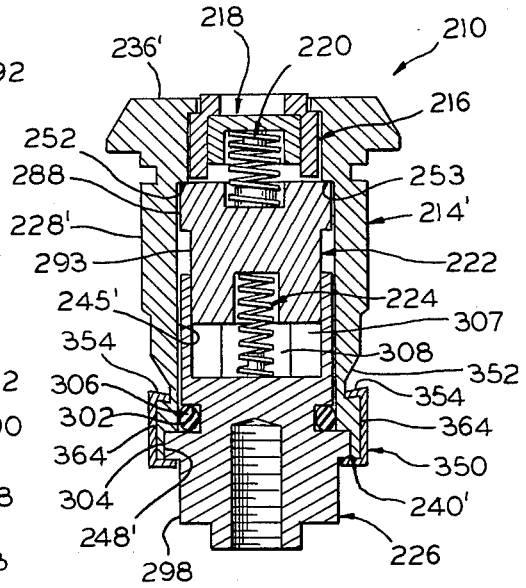
FIG. 9 is a view similar to FIG. 2 of a key ejector lock constituting a second embodiment of the invention, in an initial condition.

Referring to FIG. 9 of the drawings, a lock 210 constituting a second embodiment of the invention is constructed and operates in the same manner as the above-described lock 10, constituting a first embodiment, except for the changes or modifications described hereinafter. In order to avoid repetition of description, where a part or a portion of a part of the second lock embodiment 210 is the same as a corresponding member of the first lock embodiment 10, the reference number applied to the member in the second embodiment is the sum of the number applied thereto in the first embodiment plus 200. Similar numbering has been applied to the second embodiment with the addition of prime symbols, to denote parts or portions which have been changed or modified and otherwise correspond to members in the first embodiment. New parts or portions are given higher numbers than arrived at in the foregoing manner.

The second lock embodiment 210 illustrated in FIG. 9 is especially adapted to the use of a die cast metal barrel 214'. In this embodiment, the front end plug 216, the key ejector 218, the driver 222, and the rear end plug 226 again advantageously may be constructed of plastic, as in the first embodiment, or the parts may be constructed of other materials.

With the barrel 214' constructed of zinc die cast material, springing of the barrel end into engagement with the rear end plug 226, as in the first lock embodiment 10, would cause the material to fracture. Accordingly, the slits 38 in the barrel 14 of the first lock embodiment 10 are omitted, and the body 228' of the barrel 214' of the second lock embodiment 210 terminates at the internal circumferential retaining groove 248', of angular configuration in the second embodiment. The rear end plug 226 is inserted into the barrel body 228' until the circumferential mounting ring 304 of the plug is seated in the retaining groove 248', as illustrated in FIG. 9. At this time, an O-ring 306 in the circumferential groove 302 of the rear end plug body 298 internally engages the rear portion 245' of the barrel, to provide a seal between the plug and the barrel, in the same manner as in the first lock embodiment 10.

Figure 10:
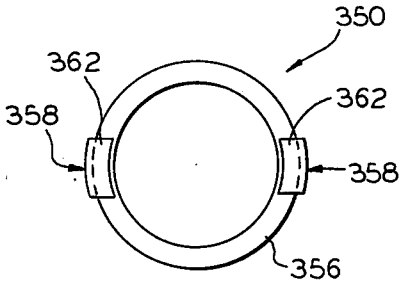
FIGS. 10 and 11 are top plan and side elevational views, respectively, of a spring clip employed in the second embodiment.
Figure 8:
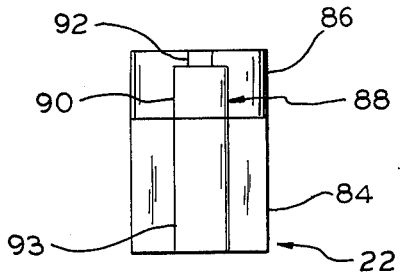
Figure 11:
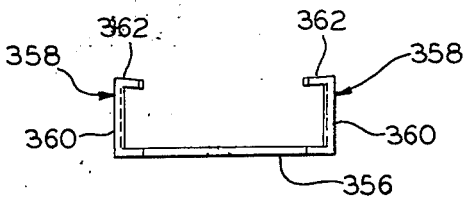

The rear end plug 226 is secured to the barrel 214' for rotation therein by means of a spring clip 350, illustrated in FIGS. 9–11. Grooves 352 are formed on opposite sides of the barrel body 228', and they leave transversely extending, forwardly facing arcuate external ledges 354, which serve for anchoring the spring clip 350. The ledges are inclined slightly, e.g., 3 to 5°, inwardly and rearwardly from a radial plane, perpendicular to the longitudinal axis of the lock 210. The ledges 354 are formed in the rear barrel portion 245', in spaced adjacent relation to the rear end 240' of the barrel 214', and also in spaced adjacent relation to the retaining groove 248' in the barrel.

Referring to FIGS. 10 and 11, the spring clip 350 includes a flat circular retaining ring 356 and a pair of diametrically opposed, laterally extending, resilient, flexible hook arms 358 integral with the ring. Each arm 358 includes a shank portion 360 in the form of a transversely curved or arcuate strip having an inner end integral with the ring 356, and the shank portion extends perpendicularly from the plane of the surface of the ring 356 at the periphery thereof. Each arm 358 also includes a flange portion 362 integral with the shank portion 360 at the outer end thereof and having transversely curved inner and outer margins. Each flange portion 362 is inclined or bent inwardly and towards the retaining ring 356, at a preferred angle of about 83°–85° to the longitudinal axis of the integral shank portion 360. The spring clip 350 preferably is integrally formed in one piece from spring steel.

The second lock embodiment 210 is assembled in the same manner as described above for the first lock embodiment 10, except for the manner in which the final closure is effected. After insertion of the remaining parts, the rear end plug 226 merely is inserted into the barrel body 228', and the plug mounting ring 304 is received in the barrel retaining groove 248', without need for spreading the end of the barrel, as with the first embodiment. The rear end plug 226 then is rotatably secured to the barrel body 228', by means of the spring clip 350. For this purpose, the retaining ring 356 of the clip 350 is positioned around the plug body 298, so as to engage the rear surface of the plug mounting ring 304 and also the rear edge of the barrel body 228'. The hook arms 358 extend forwardly from the retaining ring, i.e., in the direction of the front end 236' of the barrel. The hook arms 358 are spread, so as to clear the rear end of the barrel body 228', and then they spring into the grooves 352, for engagement with the barrel body. The shank portions 360 of the arms 358 are received in corresponding longitudinal grooves 364 disposed on opposite sides of the barrel body 228'and extending from its rear end 240'. The flange portions 362 of the arms 358 hookingly engage the ledges 354 on the barrel body 228', to thereby secure the rear end plug 226 to the barrel 214'.

The illustrative lock structures provide security against operation of the lock without a proper key. Thus, referring to the first lock embodiment 10, the driver 22 must be moved rearwardly before the lock can be operated, and it is spaced from the front end wall 70 of the front end plug 16 and concealed behind that wall and the front end wall 80 of the key ejector 18. The keyway 72 may be designed to make it difficult to insert an instrument other than a key 12 which is suitable for moving the driver against the pressure of the heavy spring 24 and then rotating the front end plug 16. The second lock embodiment 210 functions in the same manner.

The improved structure of the present invention provides increased dimensional stability against applied torque, thereby preventing wear and deformation under the load conditions to which the structure may be subjected. Thus, referring to the first embodiment, with the lock 10 mounted in a cabinet door or the like and in the locked condition illustrated in FIG. 2, torque may be placed on the square stem 100 of the rear end plug 26 by pulling on the door handle. Dimensional changes due to such torque are strongly resisted by the described structure of the driver body 84 and the driver wings 93 engaged with the body 98 of the rear end plug 26, and the structure of the driver lugs 90, as reinforced by the driver wings 93 and the driver head 86, engaged with the shouldered portion 44 of the barrel 14. Dimensional changes due to torque applied when the lock is operated between its locked and unlocked conditions against cam resistance similarly are resisted. In such case, the lock is operated in the condition illustrated in FIG. 3, and torque is transmitted through and resisted by the interengaged structure of the front end plug 16, the driver 22, and the rear end plug 26. The driver 22 and the shouldered portion 44 of the barrel 14 also resist dimensional change due to torque applied in the event that a key 12 or other instrument be inserted in the front end plug 16 and an attempt be made to rotate the plug while the driver lug means 88 remain in engagement with the shouldered portion 44. The second lock embodiment 210 functions in the same manner.

While preferred embodiments of the invention have been illustrated and described, it will be apparent to those skilled in the art that various changes and modifications may be made therein within the spirit and scope of the invention. It is intended that such changes and modifications be included within the scope of the appended claims.

Having thus described the invention, what I claim as new and desire to secure by Letters Patent is:

1. A key ejector lock which comprises:

a tubular barrel having an internal shouldered portion defining rearwardly opening circumferentially spaced notches, a tubular front end plug rotatably mounted in said barrel and having a front end wall, a cylindrical tubular side wall, and a keyway extending through the front end wall for operation of the plug by a key, said side wall having two diametrically opposed engagement slots extending longitudinally therethrough from the rear end thereof, a rear end plug rotatably mounted in said barrel and adapted for operative connection to a locking member, said rear end plug having a non-circular central slideway and two outer slideways open to the central slideway and extending outwardly from opposite sides thereof, said slideways extending longitudinally in said rear end plug from the front end thereof, a rotatable driver interposed between said plugs and mounted for axial reciprocal movement in said barrel, said driver having a head and a non-circular elongated body extending rearwardly from the head, said driver also having two lugs extending outwardly from opposite side of said head and integral therewith, and two wings extending outwardly from opposite sides of said body longitudinally therealong and integral therewith and with said lugs, said lugs and said wings being received in respective said engagement slots to provide a sliding drive connection between said front end plug and said driver, said driver body and said wings being received in said central and outer slideways, respectively, to provide a sliding drive connection between said driver and said rear end plug, said lugs being removably received in respective ones of said notches for securing said rear end plug in respective locked and unlocked rotational positions, a first spring interposed between said rear end plug and said driver and resiliently urging said driver and thereby said lugs forwardly in said barrel towards said shouldered portion, a key ejector received in said front end plug for axial reciprocal movement therein between the front end plug and said driver and engaged by a key inserted through said keyway, and a second spring interposed between said driver and said key ejector and resiliently urging said key ejector forwardly in said barrel, whereby insertion of a key in said keyway serves to move said key ejector rearwardly into abutting engagement with said driver, to thereby move said lugs rearwardly of said notches and free the rotatable parts for rotation and enable the key to rotate said front end plug for rotating said rear end plug between said locked and unlocked positions thereof, and said key ejector acts to eject the key when released in any rotational position thereof.

2. A key ejector lock as defined in claim 1 and wherein said driver head includes a base and a wall extending forwardly from the base and defining an opening for receiving the rear end of said second spring therein, whereby said lugs are continuous with said driver head across the width of the driver for a major proportion of the depth of the lugs.

3. A key ejector lock as defined in claim 1 and wherein said plugs and said driver are constructed of synthetic thermoplastic material.

4. A key ejector lock as defined in claim 1 and wherein the outside diameter of said front end plug side wall is approximately the same as the inside diameter of said shouldered portion, the diameter of said driver at said lugs is approximately the same as the inside diameter of said barrel rearwardly of said shouldered portion, and the diameter of said driver at said wings is at least about equal to the outside diameter of said front end plug side wall.

5. A key ejector lock as defined in claim 1 and wherein said barrel has an internal retaining shoulder adjacent its front end, the rear end of said barrel is slit longitudinally to provide for resilient expansion thereof, said front end plug is retained in said barrel by said retaining shoulder, and interengaging circumferential ring and groove means are provided on the slit end of said barrel and said rear end plug enabling relative rotation thereof, whereby the lock may be assembled by loading the barrel from its rear end with the rear end plug inserted in the barrel into snap-fitting interengagement of said ring and groove means.

6. A key ejector lock as defined in claim 5 and wherein the outside diameter of said front end plug side wall is approximately the same as the inside diameter of said shouldered portion, the diameter of said driver at said lugs is approximately the same as the inside diameter of said barrel rearwardly of said shouldered portion, the diameter of said driver at said wings is at least about equal to the outside diameter of said front end plug side wall, and said driver head includes a base and a wall extending forwardly from the base and defining an opening for receiving the rear end of said second spring therein, whereby said lugs are continuous with said driver head across the width of the driver for a major proportion of the depth of the lugs.

7. A key ejector lock as defined in claim 6 and wherein said barrel, plugs and driver are constructed of synthetic thermoplastic material.

8. A key ejector lock as defined in claim 1 and wherein said barrel has an internal retaining shoulder adjacent its front end, said front end plug is retained in said barrel by said retaining shoulder, internal circumferential retaining groove means are provided at the rear end of said barrel, circumferential mounting ring means are provided on said rear end plug and are received in said retaining groove means for rotation of the rear end plug relative to the barrel, and forwardly facing external ledge means are provided on said barrel in spaced adjacent relation to its rear end; and including a spring clip securing said rear end plug to said barrel for said relative rotation thereof, said clip including a retaining ring engaging said mounting ring means rearwardly thereof and around said rear end plug, and resilient flexible hook arms extending forwardly from said retaining ring into hooking engagement with said ledge means, whereby the lock may be assembled by loading the barrel from its rear end.

9. A key ejector lock as defined in claim 8 and wherein the outside diameter of said front end plug side wall is approximately the same as the inside diameter of said shouldered portion, the diameter of said driver at said lugs is approximately the same as the inside diameter of said barrel rearwardly of said shouldered portion, the diameter of said driver at said wings is at least about equal to the outside diameter of said front end plug side wall, and said driver head includes a base and a wall extending forwardly from the base and defining an opening for receiving the rear end of said second spring therein, whereby said lugs are continuous with said driver head across the width of the driver for a major proportion of the depth of the lugs.

10. A key ejector lock as defined in claim 8 and wherein said barrel is constructed of die cast metal, and said plugs and driver are constructed of synthetic thermoplastic material.

11. A key ejector lock as defined in claim 1 and wherein said key ejector includes a front end wall disposed rearwardly of the front end wall of said front end plug and extending across said keyway for abutting engagement by a key inserted through said keyway, and said driver is concealed behind the front end walls of said front end plug and said key ejector.

* * * * *